US005488845A

United States Patent [19]

Hsieh

[11] Patent Number: 5,488,845

[45] Date of Patent: Feb. 6, 1996

[54] SINGLE INSERTION LOCKING U-SHAPED PADLOCK STRUCTURE

[76] Inventor: Chen-Kuei Hsieh, No. 29, Lane 488, Section 2, Shing Ren Road, Chung Li City, Tao-Yuan Hsien, Taiwan

[21] Appl. No.: 216,992

[22] Filed: Mar. 24, 1994

[51] Int. Cl.[6] ..... E05B 67/22

[52] U.S. Cl. ..... 70/38 A; 70/39; 70/233

[58] Field of Search ..... 70/39, 38 R, 38 A, 70/38 B, 38 C, 20, 24–26, 35, 53, 233

[56] References Cited

U.S. PATENT DOCUMENTS

| | | | |
|---|---|---|---|
| 1,384,570 | 7/1921 | Bottone | 70/18 |
| 1,688,208 | 10/1928 | Rosso | 70/25 |
| 1,724,025 | 8/1929 | Jacobi | 70/379 R |
| 2,375,488 | 5/1945 | Olson | 70/38 A |
| 2,852,926 | 9/1958 | Chervenica | 70/379 R |
| 4,949,564 | 8/1990 | Barzilai | 70/39 |
| 5,199,282 | 4/1993 | Wang | 70/53 |
| 5,406,812 | 4/1995 | Jaw | 70/233 |

FOREIGN PATENT DOCUMENTS

| | | | |
|---|---|---|---|
| WO9100404 | 1/1991 | WIPO | 70/379 R |

*Primary Examiner*—Darnell M. Boucher

*Attorney, Agent, or Firm*—Lowe, Price, Leblanc & Becker

[57] ABSTRACT

A single insertion locking U-shaped padlock structure is comprised of a pintle rod, with an eccentricity consisting of a radially projecting oval surface section, supported by a concentric tensile spring, a rotation limit notch on a stepped tumbler and a fan-shaped eccentric hole in a rear protective sleeve that limits the degree of rotation of the pintle rod to achieve the functions of single direct insertion locking and automatic unlocking and, furthermore, coil springs are installed onto the two ends of a U-shaped shackle that enables, after turning the key to the unlock position during unlocking, the U-shaped shackle to be immediately disengaged from the pintle and removed, thereby enabling direct forceful insertion, automatic locking and convenient unlocking operation with simplicity and effectiveness; furthermore, the invention herein resists unlocking attempts involving heavy impact or continuous light impact to increase effective protection.

2 Claims, 6 Drawing Sheets

SECTION C-C'

SECTION B-B'

SECTION A-A'

SINGLE INSERTION LOCKING U-SHAPED PADLOCK STRUCTURE

BACKGROUND OF THE INVENTION

The invention disclosed herein relates to a lock structure utilized on the spokes of an automobile, motorcycle or bicycle wheel to effectively prevent theft and vandalism.

As can be observed with regard to the conventional devices of the aforementioned type, of which the earliest version is depicted in FIG. 1, the conventional lock structure consisted of a U-shaped shackle (1') with a hook (11') formed at one end and an interlock notch (12') machined at the opposite end, and a padlock enclosure (2') with an insertion slot (21') at one end for the aforesaid hook (11') and a key head (3') inside the opposite end that governed the horizontal moving pintle latch (22'), thereby enabling, after the insertion of the interlock notch (12') of the shackle (1'), the turning of the key head (3') caused the horizontal moving pintle latch (22') to engage the interlock notch (12') to achieve a positive locking function. During the actual utilization and operation of this type of padlock structure, the following disadvantages were never overcome:

1. The locking and unlocking operation required a longer period of time and this requirement combined with the difficult parking situation imposed unreasonable demands in actual utilization and led to user frustration.
2. The two ends of the U-shaped shackle as well as the padlock enclosure structure were not in alignment, making it impossible to accomplish mutual interlocking, such that in times of urgency or inadequate lighting (at night), there resulted erroneous operation by the user, wherein the locking operation wasted both time and energy.
3. During unlocking and locking, both the U-shaped shackle and the padlock enclosure had to be set at a certain angle for removal and insertion, often entailing repeated operations: before attaining the correct degree of rubbing and bending to enable the padlock enclosure insertion holes, pintle and other related structural components to engage despite the imprecision, thus detracting from the locking effectiveness and service life.
4. During the unlocking operation, one hand had to grasp the shackle, while the other hand inserted the key into the keyhole and, furthermore, turned the key to the unlocking position and when it was desired to remove the U-shaped shackle from the padlock enclosure, removal required placement at a certain angle of slant, which frequently involved exposing the entire key to sand or polluted water on dirty ground surfaces and led to excessive frustrations.

Another kind of U-shaped padlock structure is commonly seen on the market (as indicated in FIG. 2), wherein the two ends of the U-shaped shackle (10") are positioned inside round holes and have slots (11") with narrow openings, and inside the tubular enclosure (20") is a long flat bar (30"), the two ends of which are inserted into positioner seats (21") at both extremities, that is a pintle controlled and rotated by the inserted key (40"); when the width of the long flat bar (30") is rotated to a vertical orientation, the shackle (10") can be smoothly inserted into the pin holes (50") and the long flat bar (30") fits into the slots (11") at the lower ends of the shackle (10"); when the key (40") is turned once again to rotate the width of the long flat bar (30") into a horizontal orientation, the consequent locking prevents removal (as indicated in FIG. 3). Although this kind of padlock structure meets the requirements of convenient unlocking and locking functions, it is necessary during operation to first grasp the tubular enclosure (20") with one hand, while using the other hand to hold and insert the key (40") into the pintle to rotate the width of the long flat bar (30") into the vertical orientation and, furthermore, until the long flat bar (30") is securely positioned; then the U-shaped shackle (10") must be manually inserted into the pin holes (50'), while also maintaining the locking position, after which the key is turned to lock the U-shaped shackle (10") into the tubular enclosure (20"); furthermore, the unlocking operation is especially troublesome since it is necessary to grasp the tubular enclosure (20") with one hand, while using the other hand to insert the key (40") into the pintle to rotate the aforesaid pintle to the unlocking position, and then forcefully pull the bend of the U-shaped shackle (10") around the vehicle wheel hub to remove the U-shaped shackle (10") from the tubular enclosure (20"), wherein it is this phase of operation that frequently and easily causes damage due to the impact of the U-shaped shackle (10") against the vehicle; based on the foregoing description of the complicated unlocking and locking operation procedures, it can be acknowledged that this kind of conventional padlock requires the user to employ two hands in a difficult operating process and, therefore, this kind of padlock is inconvenient from the standpoint of practicality and requires further improvements.

A kind of relatively new product of recent research and development is the Example B "Improved U-shaped Lock Structure" (as indicated in FIG. 4), that is comprised of a U-shaped shackle (10'''), a tubular enclosure (20'''), two positioner seats (30'''), a pintle frame (40'''), a push plate (50''') and a pintle (60'''); wherein, the pintle (60''') is utilized to rotate the push tab (51''') on the push plate (50''') to control the from and rear positioning of the pintle frame (40''') to achieve the objectives of unlocking and locking. Although this example is more advanced in terms of convenience and practicality than the other kinds of conventional padlocks in the foregoing descriptions, the resulting overall padlock structure is of excessive complexity, which increases the padlock weight and production costs and, furthermore, the structure of this example has several obvious shortcomings; as indicated in FIG. 5 and FIG. 6, when in the locked mode, if the lateral ends of the padlock are subjected to heavy impact or continuous light impact, then the accumulated effects of the impact causes the coil spring (44''') to collapse and the consequent movement of the pintle frame (40''') and dislocation of the grooves (12''') on the U-shaped shackle (10'''), thereby disabling the protective function of the padlock.

In view of the various shortcomings of conventional padlocks, the invention herein offers a kind of padlock that utilizes a pintle rod, with an eccentricity consisting of a radially projecting oval surface section, supported by a concentric tensile spring, a rotation limit notch on a stepped tumbler and a fan-shaped eccentric hole in a rear protective sleeve that limits the degree of rotation of the pintle rod to achieve the functions of single direct insertion locking and automatic unlocking and, furthermore, coil springs are installed onto the two ends of a U-shaped shackle that enables, after turning the key to the unlock position during unlocking, the U-shaped shackle to be immediately disengaged from the pintle and removed.

The following explanations further describe the major features of the invention herein:

The innovative improvements offered by the insertion locking U-shaped padlock structure invention herein include the U-shaped shackle, the tubular padlock enclosure, the key head device,: the stepped tumbler, the concentric tensile spring, the front protective sleeve, the pintle rod, the rear protective sleeve, a number of short pins and other structural components.

Since the structural assembly of the aforementioned padlock is simple and expedient, therefore, the aforementioned padlock does not require complex assembly procedures, a factor that significantly reduce assembly and manufacturing costs.

The structure of the aforementioned padlock is durable, especially the pintle rod, which is constructed out of a steel alloy of exceptional hardness that has undergone heat treatment, enabling the pintle rod to withstand heavy impact without being damaged and, furthermore, the pintle rod, interlock holes and insertion interlocked structural components resist wear due to friction to ensure an extended service life.

The locking operation of the U-shaped shackle to the tubular padlock enclosure of the invention herein not only directly enables the two ends of the U-shaped shackle to forcefully inserted into the interlock holes, locking only requires a single operation to achieve the objectives of insertion and automatic locking and, furthermore, when the invention herein is unlocked, it is only necessary to first turn the key to the unlock position, after which, the U-shaped shackle is immediate disengaged from the pintle rod and easily removed and it is unnecessary to, as in the case of conventional padlocks, to turn the key head to adjust the eccentric angle of the pintle rod to achieve the objectives of insertion locking or unlocking; therefore, the unlocking and locking operation of the invention herein is extremely easy and convenient.

Especially worthy of further elaboration is that the unlocking and locking operation of the invention herein is controlled by the regulative action of the rotational eccentric angle of the pintle rod, wherein it is impossible to unlock the invention herein without utilizing the key to turn the key head device, thereby enabling the tubular padlock enclosure of the invention herein to withstand unlocking attempts based on heavy impact or continuous light impact; therefore, the invention herein ensures maximum protection effectiveness.

The other objectives and functions of the invention herein are illustrated in the following attached drawings which have been provided to facilitate the further understanding of the evaluation committee members, with the qualification that the following attached drawings are only provided as a means of explaining the preferred embodiments of the invention herein and shall not be construed as any limitation whatsoever of the scope and claims of the invention herein; therefore, all inventions that are similar in theory or spirit to the invention herein,, regardless of any superficial embellishments or modifications what,vet, shall be included as constructs protected under the claims of the invention herein and elucidated by the following attached drawings.

DETAILED DESCRIPTION OF THE INVENTION

Figure 7:
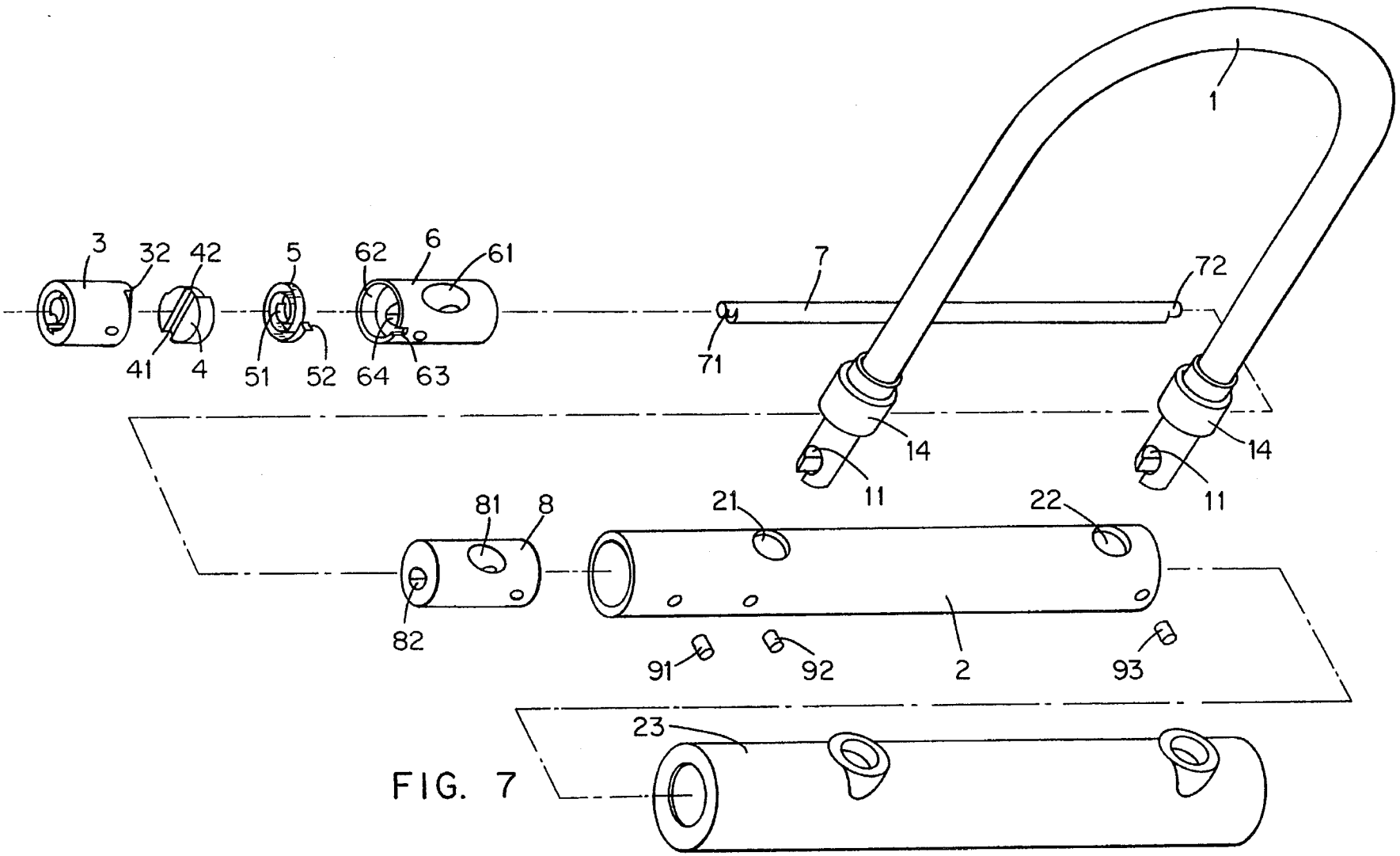
FIG. 7 is an isometric drawing of the invention herein.
Figure 8:
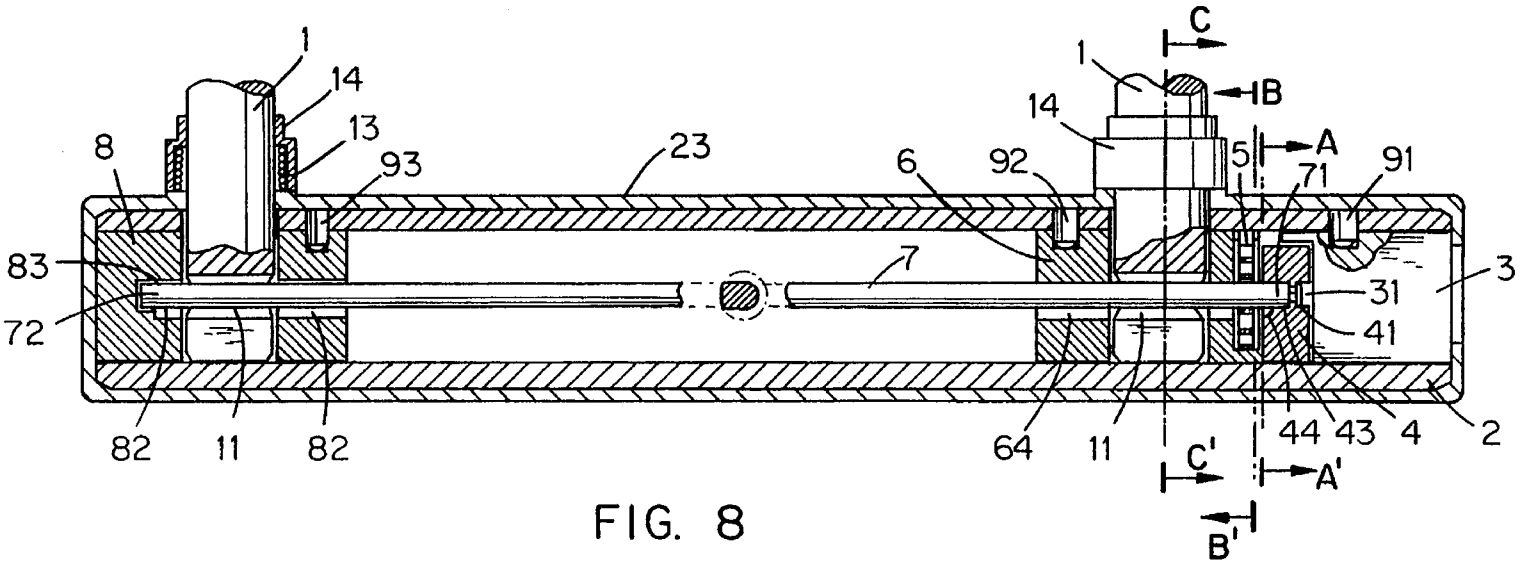
FIG. 8 is an orthographic cross-sectional drawing of the invention herein when locked.
Figure 10:
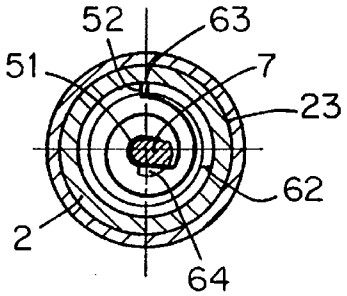
FIG. 10 is an orthographic cross-sectional drawing of the invention herein when locked, showing the compressed shape of the concentric tensile spring.
Figure 9:
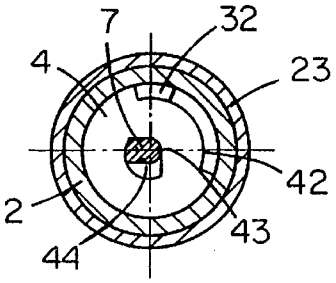
FIG. 9 is an orthographic cross-sectional drawing of the invention herein when locked, showing the stepped tumbler.

FIG. 7 is isometric exploded drawing of the invention herein. The preferred embodiment of the invention herein includes a U-shaped shackle (1), a tubular padlock enclosure (2), a key head device (3), a stepped rambler (4), a concentric tensile spring (5), a front protective sleeve (6), a pintle rod (7), a rear protective sleeve (8) and a number of snort pins; of which, there are pintle interlock holes (11) extending laterally through the front side of the two ends of the U-shaped shackle (1) and the aforesaid pintle interlock holes (11) are Ω-shaped and, furthermore, coil springs (13) are installed onto the front section of the ends of the U-shaped shackle (1) and each coil spring (13) is secured by a sleeve seat (14); the tubular padlock enclosure (2) consists of a hollow tube, the outer surface of which is covered with by a protective plastic sleeve (23), with a front insertion hole (21) and rear insertion hole (22) through the upper surface, wherein the distance between the aforesaid insertion holes equivalent to the distance between the two ends of the U-shaped shackle (1); the key head device (3) is fastened into the front end of the tubular padlock enclosure (2) by the short pin (91); the pintle shaft (31) is inserted into the long slot (41) on the stepped tumbler (4) and there is a rotation limit notch (42) along the circumference of the step tumbler (4) that is stopped by the protruding tab (32) extending from the front end of the key head device (3) and at the other end and center of the key head device (3) is a graduated hole, of which the smaller hole at the inner level serves as the shaft connector hole (43) for the pintle rod (7) and the larger hole at the outer level consists of a fan-like section that serves as a position limiter slot (44) (as indicated in FIG. 8 and FIG. 9) for the eccentric movement of the pintle rod (7); the concentric tensile spring (5) is wound such there is an oval ring (51) in the center that fits onto the pintle rod (7) and a catch tab (52) at the outer end; the aforementioned front protective sleeve (6) is secured inside the tubular padlock enclosure (2) by the short pin (92) and positioned at the front insertion hole (21) such that the front insertion hole (21) is aligned with the insertion hole (61) and, furthermore, there is a concentric spring seat (62) in the forward end of the front protective sleeve (6) and there is a positioner slot (63)

through the rim of the concentric spring seat (62) that is utilized to accommodate the insertion of the catch tab (52) (as indicated in FIG. 8 and FIG. 10) at the end of the concentric tensile spring (5), furthermore, there is a fan-shaped eccentric insertion hole (64) that extends through the cylinder of the front protective sleeve (6); the pintle rod (7) is of eccentric shape, with the eccentricity consisting of a radially projecting oval surface section and, furthermore, there are small diameter pin shafts (71) and (72) extending from the front and rear ends, respectively, of the pintle rod (7); the rear protective sleeve (8) is secured inside the tubular padlock enclosure (2) by the short pin (93) and positioned at the rear insertion hole (22) such that the rear insertion hole (22) is aligned with the insertion hole (81) and, furthermore, there is a fan-shaped eccentric hole (82) in the cylinder of the rear protective sleeve (8), with a graduated diameter holes and at the lower end of the aforesaid eccentric hole (82), wherein the smaller hole among the aforesaid graduated diameter holes serves as the shaft connector hole (83) for the pintle rod (7) and the larger hole is the eccentric hole (82), which serves as a positioner slot hole that limits the extent of angular movement due to the eccentric surface projection of the pintle rod (7).

When the aforementioned structural components of the invention herein are assembled, the rear protective sleeve (8), the pintle rod (7), the front protective sleeve (6), the concentric tensile spring (5), the stepped tumbler (4) and the key head device (3) are first assembled into the tubular padlock enclosure (2), following which, the pin shafts (71) and (72) at the ends of the pintle rod (7) are inserted into the shaft connector hole (43) on the stepped tumbler (4) and into the shaft connector hole (83) on the rear protective sleeve (8), respectively, and then the key head device (3), the front protective sleeve (6) and the rear protective sleeve (8) are fastened in place by the short pins (91), (93) and (92), respectively.

Figure 1:
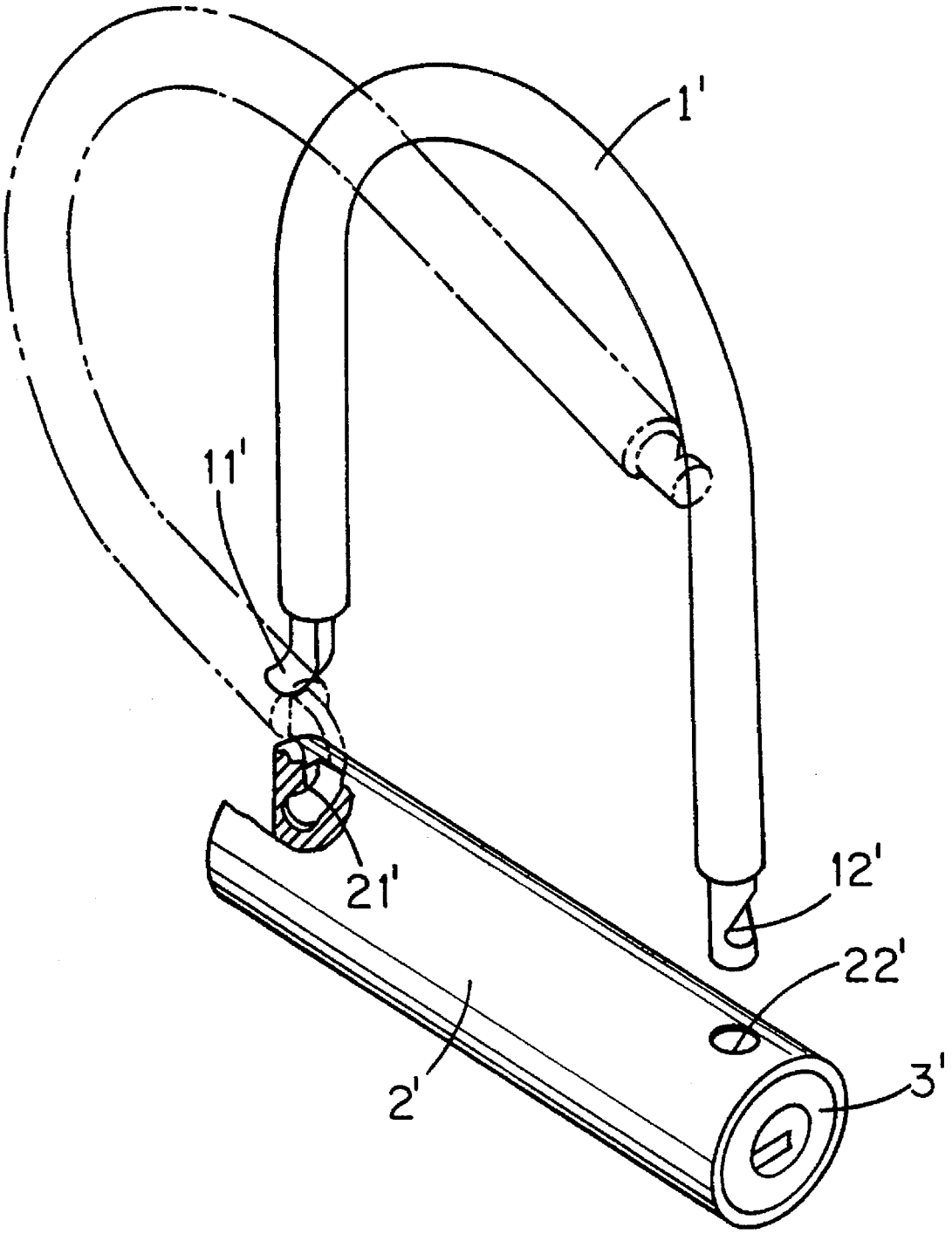
FIG. 1 (PRIOR ART)
FIG. 1 is an isometric drawing of a conventional U-shaped padlock (1)..
Figure 3:
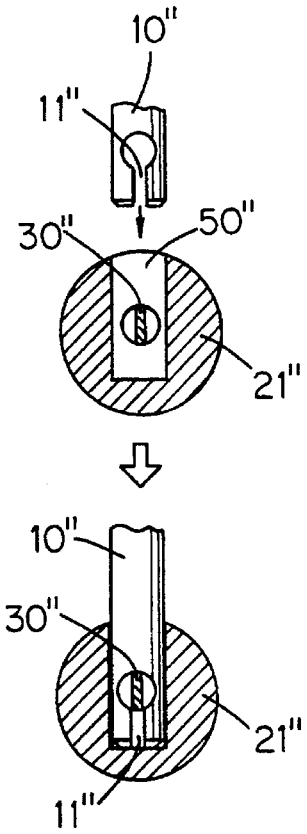
FIG. 3 (PRIOR ART)
FIG. 3 is orthographic drawing, illustrating the operation of a conventional U-shaped padlock (2).
Figure 2:
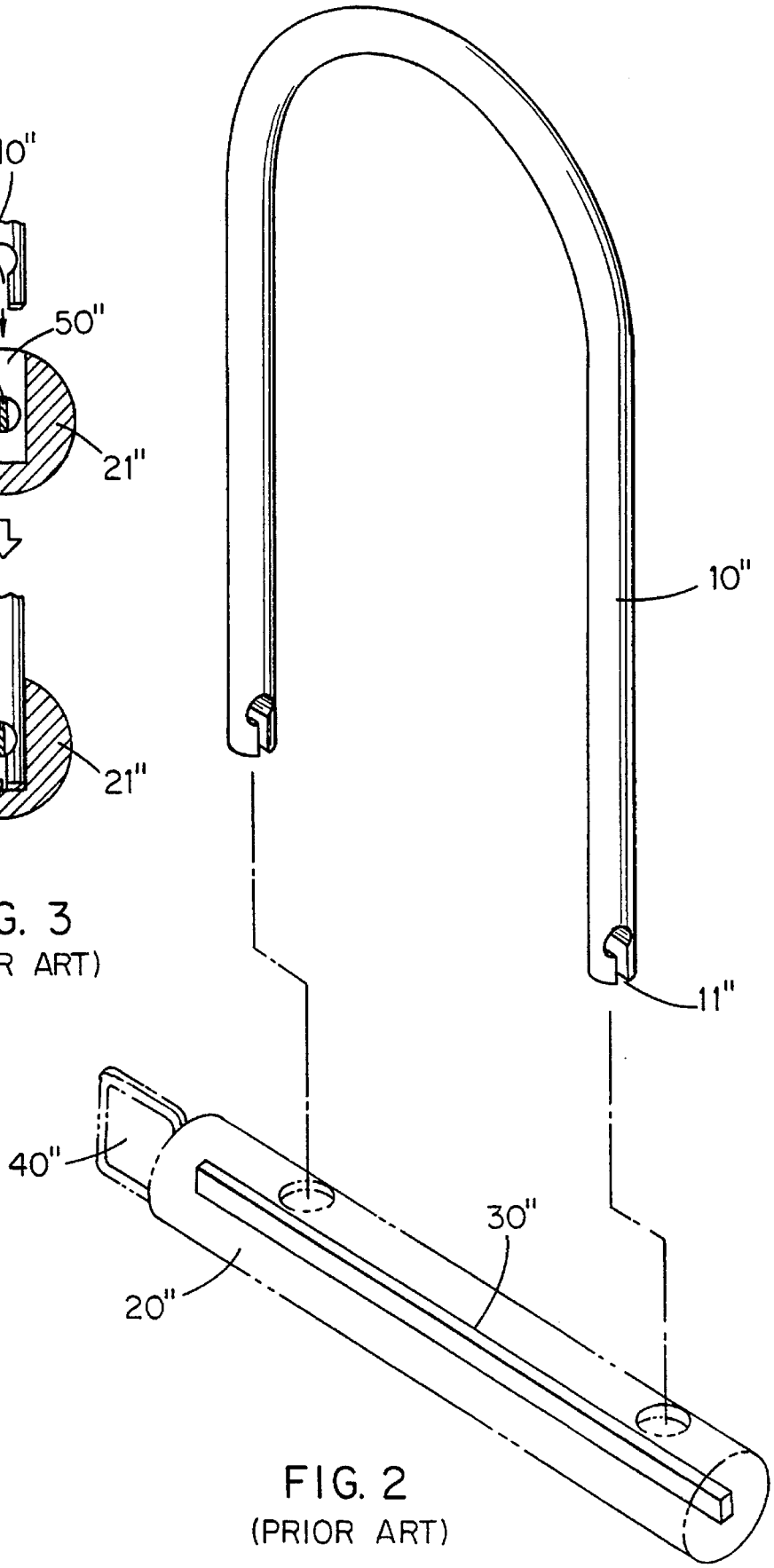
FIG. 2 (PRIOR ART)
FIG. 2 is an isometric drawing of a conventional U-shaped padlock (2).
Figure 4:
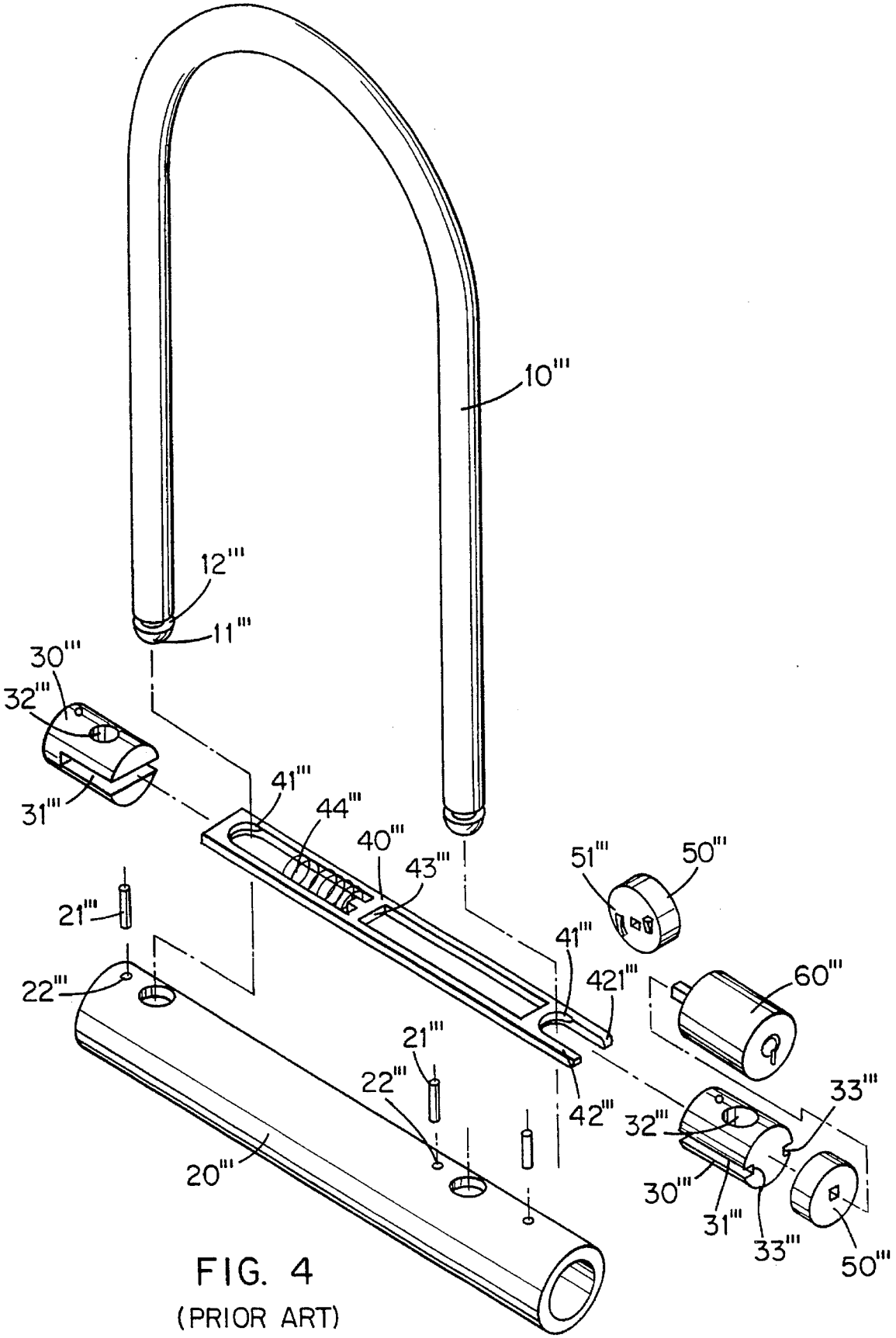
FIG. 4 (PRIOR ART)
FIG. 4 is an isometric drawing of an conventional U-shaped padlock (3).
Figure 11:
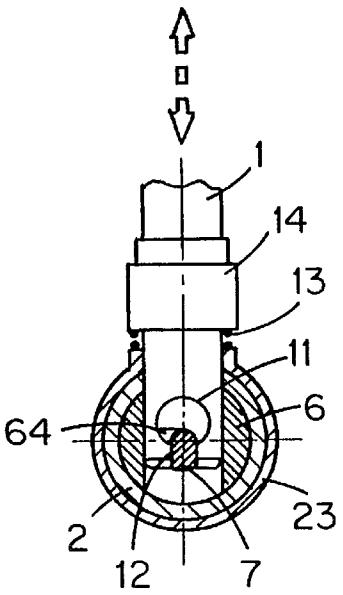
FIG. 11 is an orthographic cross-sectional drawing of the invention herein when locked, showing the pintle rod in the standard vertical orientation.
Figure 5:
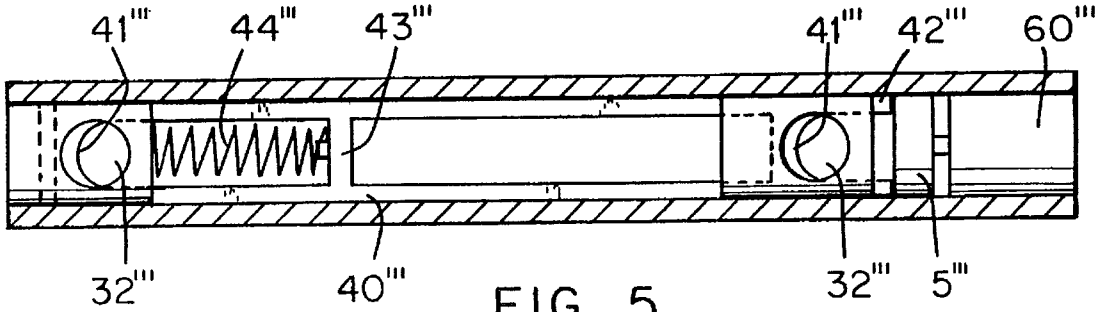
FIG. 5 (PRIOR ART)
FIG. 5 is an orthographic cross-sectional drawing of a conventional U-shaped padlock (3).
Figure 6:
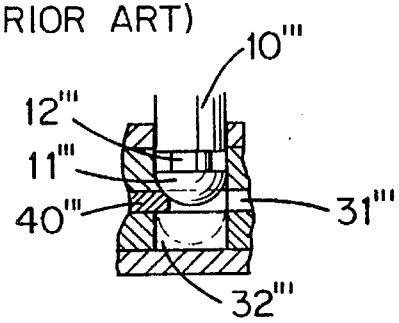
FIG. 6 (PRIOR ART)
FIG. 6 is an orthographic cross-sectional drawing of a conventional U-shaped padlock (3).
Figure 12:
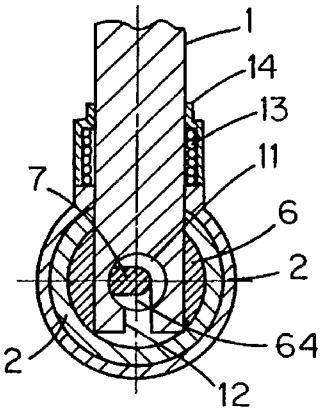
FIG. 12 is an orthographic cross-sectional drawing of the invention herein when locked, showing the front protective sleeve.

As indicated in FIG. 11 and FIG. 12, when the padlock of the invention is placed in the locked mode, the two ends of the U-shaped shackle (1) are inserted into the insertion holes (21) and (22), with the aforementioned two ends inserted firmly until reaching the bottom, at which point, the Ω-shaped pintle interlock holes (11) are pushed into the insertion holes (61) and (81), the narrower sections of the interlock holes (12) initially press against the horizontally oriented eccentric side (73) of the pintle rod (7), thereby causing the pintle rod (7) to revolve into a vertical orientation (as indicated in FIG. 11), thereby enabling the passage of the interlock hole (12); when the aforesaid two ends of the U-shaped shackle (1) are tightly fixed to the bottom [and the coil springs (13) are in a compressed state within the sleeve seats (14)], the pintle rod (7) is then fully inserted into the pintle interlock holes (12), meanwhile, the pintle rod (7) reverse rotates due to the action of the concentric tensile spring (5), with the extent of rotation limited by the position limiter slot (44) of the stepped tumbler (4), wherein the fan-shaped eccentric insertion hole (64) that extends through the cylinder of the front protective sleeve (6) and the fan-shaped eccentric hole (82) in the cylinder of the rear protective sleeve (8) bias the rotation to the horizontal orientation (as indicated in FIG. 12), thereby causing the eccentric side (73) of the pintle rod (7) to be fully inserted inside the pintle interlock holes (11) to complete the locking operation.

Figure 13:
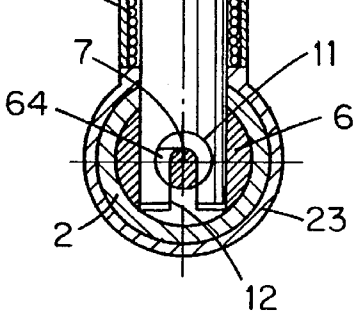
FIG. 13 is an orthographic cross-sectional drawing of the invention herein when unlocked, showing the front protective sleeve.

When the padlock of the invention herein is required to be unlocked from the locked mode, then a key (not shown in the attached drawings) is utilized turn the keyhole of the key head device (3), thereby causing the pintle shaft (31) to revolve the stepped tumbler (4) by approximately 90 degrees, meanwhile, the pintle rod (7) is actuated by the position limiter slot (44) of the stepped tumbler (4) and also revolves 90 degrees, which in turn causes the eccentricity of the pintle rod (7) to become vertically oriented (as indicated in FIG. 13) and thereby permits the passage of the interlock holes (12), which enables the separation of the pintle rod (7) from the pintle interlock holes (11) and attain the objective of unlocking.

There is feature worth further elaboration with respect to the foregoing description of the unlocking process, when the unlocking operation causes the eccentricity of the pintle rod (7) to become of vertical orientation (as indicated in FIG. 13), since the U-shaped shackle (1) is subjected to the force of the coil springs (13), the two ends of the U-shaped shackle (1) are moved to an upward position, thereby causing the pintle rod (7) to be situated in between the interlock holes (12) (as indicated in FIG. 11), which enables the removal of the U-shaped shackle (1); therefore, when the invention is unlocked and after the key is turned to the unlock position, the key returns to the original position and can be removed and stored, thereby making it unnecessary to utilize the key repeatedly for the remainder of the unlocking operation.

Based on the foregoing description, it can be acknowledged that the invention herein enables the U-shaped shackle (1) to be locked into the tubular padlock enclosure (2), wherein the two ends of the U-shaped shackle (1) can not only be forcefully inserted into the insertion holes, but also attain the objectives of interlocking and automatic locking in a single operation; furthermore, when the invention herein is unlocked, it is only necessary to turn the key to the unlocking position, after which the U-shaped shackle (1) is immediately released from the interlocking function of the pintle rod (7) for removal, and it is unnecessary, as in the case of conventional padlocks, to turn the key head device to adjust the eccentric angle of the pintle rod to unlock or lock for the purpose of removal; therefore, the unlocking and locking operation of the invention herein is simple and convenient.

Furthermore, the unlocking and locking operation of the invention herein is controlled by rotational eccentric angle of a regulating pintle rod (7), wherein unlocking cannot be attained without the actuation by a key turning the key head device and is further enabled by a highly impact resistant shafts in the tubular padlock enclosure (1) that cannot be dislodged; therefore, the invention herein offers maximum effective protection.

In summation of the foregoing detailed description, the structure of the invention herein is of a new and innovative type and, furthermore, possesses total and unquestionable practical value; therefore, since the invention herein fully complies with the requirements of the patent law, the invention herein is duly submitted in application for the approval and the awarding of the commensurate patent rights.

What is claimed is:

1. A padlock comprising:

a U-shaped shackle including a pair of Ω-shaped pintle interlock holes on each end thereof;

a tubular padlock enclosure, a front protective sleeve received within the tubular padlock enclosure at a front end thereof, a rear protective sleeve received within the tubular padlock enclosure at the rear end thereof, a concentric tensile spring disposed within the tubular padlock enclosure adjacent the front protective sleeve, a stepped tumbler disposed within the tubular padlock enclosure adjacent and in cooperation with the spring, said stepped tumbler including a rotation limit notch disposed along a circumference thereof, a fan-shaped eccentric insertion hole extending through the front protective sleeve, the stepped tumbler and a portion of the rear protective sleeve, an eccentric pintle rod disposed within the tubular padlock enclosure in the eccentric insertion hole and movable between an unlocked position and a locked position, the eccentric insertion hole limiting the rotation of the pintle rod between the locked and unlocked position, the concentric tensile spring including an oval ring at the center thereof adapted to fit in surrounding relationship to the pintle rod, said spring urging the pintle rod in the locked position, wherein when the shackle is inserted into the tubular padlock enclosure, the pintle rod is first guided by the pintle interlock holes into the unlocked position, and upon further insertion of the shackle into the tubular padlock enclosure, the spring urges the pintle rod into the locked position, thereby causing the shackle to be locked within the tubular padlock enclosure.

2. The padlock of claim 1, further comprising a pair of coil springs installed on either end of the shackle inwardly from the pintle interlock holes, and a pair of sleeve seats securing the pair of coil springs in position.

* * * * *